US007639188B2

(12) United States Patent
Ying et al.

(10) Patent No.: US 7,639,188 B2
(45) Date of Patent: Dec. 29, 2009

(54) RADIO ANTENNA FOR A COMMUNICATION TERMINAL

(75) Inventors: Zhinong Ying, Lund (SE); Johan Andersson, Malmö (SE)

(73) Assignee: Sony Ericsson Mobile Communications AB, Lund (SE)

( * ) Notice: Subject to any disclaimer, the term of this patent is extended or adjusted under 35 U.S.C. 154(b) by 242 days.

(21) Appl. No.: 11/740,312

(22) Filed: Apr. 26, 2007

(65) Prior Publication Data

US 2008/0246685 A1 Oct. 9, 2008

Related U.S. Application Data

(60) Provisional application No. 60/910,253, filed on Apr. 5, 2007.

(51) Int. Cl.
*H01Q 1/24* (2006.01)

(52) U.S. Cl. ..... 343/702; 343/725

(58) Field of Classification Search ..... 343/700 MS, 343/702, 846, 725

See application file for complete search history.

(56) References Cited

U.S. PATENT DOCUMENTS

| | | | | |
|---|---|---|---|---|
| 6,774,850 | B2 * | 8/2004 | Chen | 343/700 MS |
| 7,050,010 | B2 * | 5/2006 | Wang et al. | 343/702 |
| 7,084,831 | B2 * | 8/2006 | Takagi et al. | 343/860 |
| 7,319,432 | B2 * | 1/2008 | Andersson | 343/702 |
| 2003/0058176 | A1 | 3/2003 | Keilen et al. | |
| 2004/0017329 | A1 | 1/2004 | Fang et al. | |
| 2005/0264458 | A1 | 12/2005 | Takagi et al. | |
| 2006/0211373 | A1 | 9/2006 | Lind et al. | |

FOREIGN PATENT DOCUMENTS

| | | |
|---|---|---|
| EP | 1 359 638 | 11/2003 |

OTHER PUBLICATIONS

International Search Report for corresponding Application No. PCT/EP2007/060438 mailed Jan. 14, 2008.

* cited by examiner

*Primary Examiner*—Tan Ho
(74) *Attorney, Agent, or Firm*—Renner, Otto, Boisselle & Sklar, LLP

(57) ABSTRACT

A radio antenna device for a radio communication terminal, e.g. a mobile phone, comprising a flat ground plane, a first monopole antenna element in the form of a meandered antenna element, and a second monopole antenna element having a folded three-dimensional box-like shape. The meandered antenna element has a first radio signal feeding point disposed at the ground plane. Furthermore, the meandered antenna element is located in the same plane as said ground plane in a direction of extension of the ground plane. The folded three-dimensional box-like shaped antenna element has a second radio signal feeding point disposed at a support member of the ground plane. Furthermore, the folded three-dimensional box-like shaped antenna element is located adjacent to said meandered antenna element. The meandered antenna element is operable in the first frequency band region and the folded three-dimensional box-like shaped antenna element is operable in the second frequency band region.

13 Claims, 7 Drawing Sheets

RADIO ANTENNA FOR A COMMUNICATION TERMINAL

CROSS REFERENCE TO RELATED APPLICATION

This application claims priority under 35 U.S.C. § 119 to U.S. Provisional Application No. 60/910,253, filed Apr. 5, 2007, the entire disclosure of which is incorporated herein by reference.

TECHNICAL FIELD

The present invention relates generally to antennas for radio communication terminals and, more particularly, to antennas devised to be incorporated into portable terminals and having a wide bandwidth to facilitate operation of the portable terminals within different frequency bands.

BACKGROUND

Since the end of the $20^{th}$ century the cellular telephone industry has had enormous development in the world. From the initial analog systems, such as those defined by the standards AMPS (Advanced Mobile Phone System) and NMT (Nordic Mobile Telephone), the development has during recent years been almost exclusively focused on standards for digital solutions for cellular radio network systems, such as D-AMPS (e.g., as specified in EIA/TIA-IS-54-B and IS-136) and GSM (Global System for Mobile Communications). Different digital transmission schemes are used in different systems, e.g. Time Division Multiple Access (TDMA) or Code Division Multiple Access (CDMA). Currently, the cellular technology is entering the so called $3^{rd}$ generation, providing several advantages over the former, $2^{nd}$ generation, digital systems referred to above. Among those advantages an increased bandwidth will be provided, allowing effective communication of more complex data. The $3^{rd}$ generation of mobile systems is referred to as the UMTS (Universal Mobile Telecommunications System) in Europe and CDMA2000 in the USA. Moreover, it is believed that the first generation of Personal Communication Networks (PCNs), employing low cost, pocket-sized, cordless telephones that can be carried comfortably and used to make or receive calls in the home, office, street, car, etc., will be provided by, for example, cellular carriers using the next generation digital cellular system infrastructure.

One evolution in cellular communication services involves the adoption of additional frequency bands for use in handling mobile communications, e.g., for Personal Communication Services (PCS) services. Taking the U.S. as an example, the Cellular hyperband is assigned two frequency bands (commonly referred to as the A frequency band and the B frequency band) for carrying and controlling communications in the 800 MHz region. The PCS hyperband, on the other hand, is specified in the United States to include six different frequency bands (A, B, C, D, E and F) in the 1900 MHz region. Thus, eight frequency bands are now available in any given service area of the U.S. to facilitate communication services. Certain standards have been approved for the PCS hyperband (e.g., PCS1900 (J-STD-007)), while others have been approved for the Cellular hyperband (e.g., D-AMPS (IS-136)). Other frequency bands in which these devices will be operating include GPS (operating in the 1.5 GHz range) and UMTS (operating in the 2.0 GHz range). Each one of the frequency bands specified for the Cellular and PCS hyperbands is allocated a plurality of traffic channels and at least one access or control channel. The control channel is used to control or supervise the operation of mobile stations by means of information transmitted to and received from the mobile stations. Such information may include incoming call signals, outgoing call signals, page signals, page response signals, location registration signals, voice channel assignments, maintenance instructions, hand-off, and cell selection or reselection instructions as a mobile station travels out of the radio coverage of one cell and into the radio coverage of another cell. The control and voice channels may operate using either analog modulation or digital modulation.

The signals transmitted by a base station in the downlink over the traffic and control channels are received by mobile or portable terminals, each of which has at least one antenna. Historically, portable terminals have employed a number of different types of antennas to receive and transmit signals over the air interface. For example, monopole antennas mounted perpendicularly to a conducting surface have been found to provide good radiation characteristics, desirable drive point impedances and relatively simple construction. Monopole antennas can be created in various physical forms. For example, rod or whip antennas have frequently been used in conjunction with portable terminals. For high frequency applications where an antenna's length is to be minimized, another choice is the helical antenna. In addition, mobile terminal manufacturers encounter a constant demand for smaller and smaller terminals. This demand for miniaturization is combined with desire for additional functionality such as having the ability to use the terminal at different frequency bands and different cellular systems.

In the known prior art, it has been commercially desirable to offer portable terminals which are capable of operating in widely different frequency bands, e.g., bands located in the 800 MHz, 900 MHz, 1500 MHz, 1800 MHz, 1900 MHz, 2.0 GHz and 2.45 GHz regions. However, in a near future it is expected that it will be increasingly desirable to offer portable terminals which are also capable of operating in frequency bands located within the range from 3.1 GHz up to and including 10.6 GHz, commonly referred to as the Ultra-Wideband (UWB).

Today, the concept of built-in antennas is well known and commonly used by mobile telephone manufacturers, e.g. SONY ERICSSON® and NOKIA®. However, the performance is still a problem when even wider band capabilities are desirable, e.g. when UWB frequency bands are to be covered. Consequently, in the future prior art antenna designs will still be a limiting factor when developing radio terminals with adequate bandwidth to cover plural bands. A more general problem with built-in antenna is not only small bandwidth, but also significantly worse gain performance than a traditional external antenna, e.g. some kind of stub antenna.

Hence, there appears to be a need for providing a multiband radio antenna device that mitigates, alleviates or eliminates one or more of the above-mentioned deficiencies or disadvantages in the known prior art. More specifically, there appears to be a need for providing a multi-band radio antenna device having a structure suitable for built-in antennas, which at the same time has a wide bandwidth which enables the antenna to be operable at a plurality of frequency bands.

SUMMARY OF THE INVENTION

An aspect of the invention relates to a radio antenna device for a radio communication terminal. The antenna device is operable in a first and a second frequency band region, respectively, the first frequency band region being a lower frequency band region than the second frequency band region. The antenna device comprises a flat ground plane; a flat first monopole antenna element having a first radio signal feeding point disposed at the ground plane, wherein the flat first monopole antenna element is located in the same plane as said ground plane in a direction of extension of said ground plane; and a folded second monopole antenna element having a second radio signal feeding point disposed at the ground plane, wherein the folded second monopole antenna element is located adjacent to said flat first antenna element; and wherein the flat first monopole antenna element is operable in the first frequency band region and the second monopole antenna element is operable in the second frequency band region.

In one embodiment, the folded second monopole antenna has a three-dimensional box-like shape.

In one embodiment, the folded second monopole antenna element comprises a plurality of side surfaces and at least one of said side surfaces is located in the same plane as said ground plane in the same direction of extension as said flat first antenna element.

In one embodiment, the folded monopole antenna element comprises first, second, third, and fourth side surfaces, respectively, wherein the first side surface abuts perpendicularly against the second side surface, the second side surface abuts perpendicularly against the third side surface, the third side surface abuts perpendicularly against the fourth side surface, and there is a gap between the first and fourth side, wherein the first, second, third and fourth side surfaces together enclose a hollow interior, the hollow interior having two open ends which are located opposite to each other, and wherein the first, second, third, and fourth side surfaces, the hollow interior, and the two open ends of the hollow interior are arranged in relation to each other such that a non-closed box-like shape is formed by the first, second, third, and fourth side surfaces, the hollow interior, and the two open ends of the hollow interior.

In one embodiment, the antenna device further comprises fifth and sixth surfaces, wherein a lower portion of the third side surface abuts perpendicularly against the fifth surface, and the fifth surface abuts perpendicularly against the sixth surface, the sixth surface further being attached to a feeding portion connected to the second radio signal feeding point.

In one embodiment, the ground plane further comprises a support member attached to said ground plane at a side edge of said ground plane and further protruding substantially perpendicularly out from said ground plane, wherein the second radio signal feeding point is disposed at a center portion of said support member.

In one embodiment, the first radio signal feeding point and the second radio signal feeding point are separate feeding points.

In one embodiment, the flat first antenna element comprises an elongated meander portion.

In one embodiment, the elongated meander portion protrudes away from said side edge of the ground plane and extends substantially parallel to said side edge in a direction from a center portion of said side edge towards an outer edge of said side edge.

In one embodiment, the first antenna element is configured to be operable in the first frequency band, the first frequency band being a frequency band located in the 800 MHz, 900 MHz or 1500 MHz region.

In one embodiment, the second antenna element is configured to be operable in the second frequency band, the second frequency band being a frequency band located in the 1800 MHz, 1900 MHz, 2.0 GHz, 2.45 GHz, 3.1 GHz, 5.0 GHz, 5.8 GHz, or 10.6 GHZ region.

In one embodiment, the second antenna element is operable in a frequency band being a frequency band located within the range of 3.1-10.6 GHz.

In one embodiment, the antenna device has a shape as illustrated in any of the FIG. 1, 2 or 3 of the drawings.

The different features of the above-mentioned antenna device can be combined in any combination.

A further aspect of the invention relates to a communication terminal comprising the above-mentioned antenna device. The communication terminal may a device from the group comprising: a portable radio communication equipment, a mobile radio terminal, a mobile telephone, a cellular telephone, a pager, a communicator, an electronic organizer, a smart phone and a computer.

BRIEF DESCRIPTION OF THE DRAWINGS

Further objects, features and advantages of the invention will appear from the following detailed description of embodiments of the invention, wherein embodiments of the invention will be described in more detail with reference to the accompanying drawings, in which.

DETAILED DESCRIPTION OF EMBODIMENTS

Figure 1:
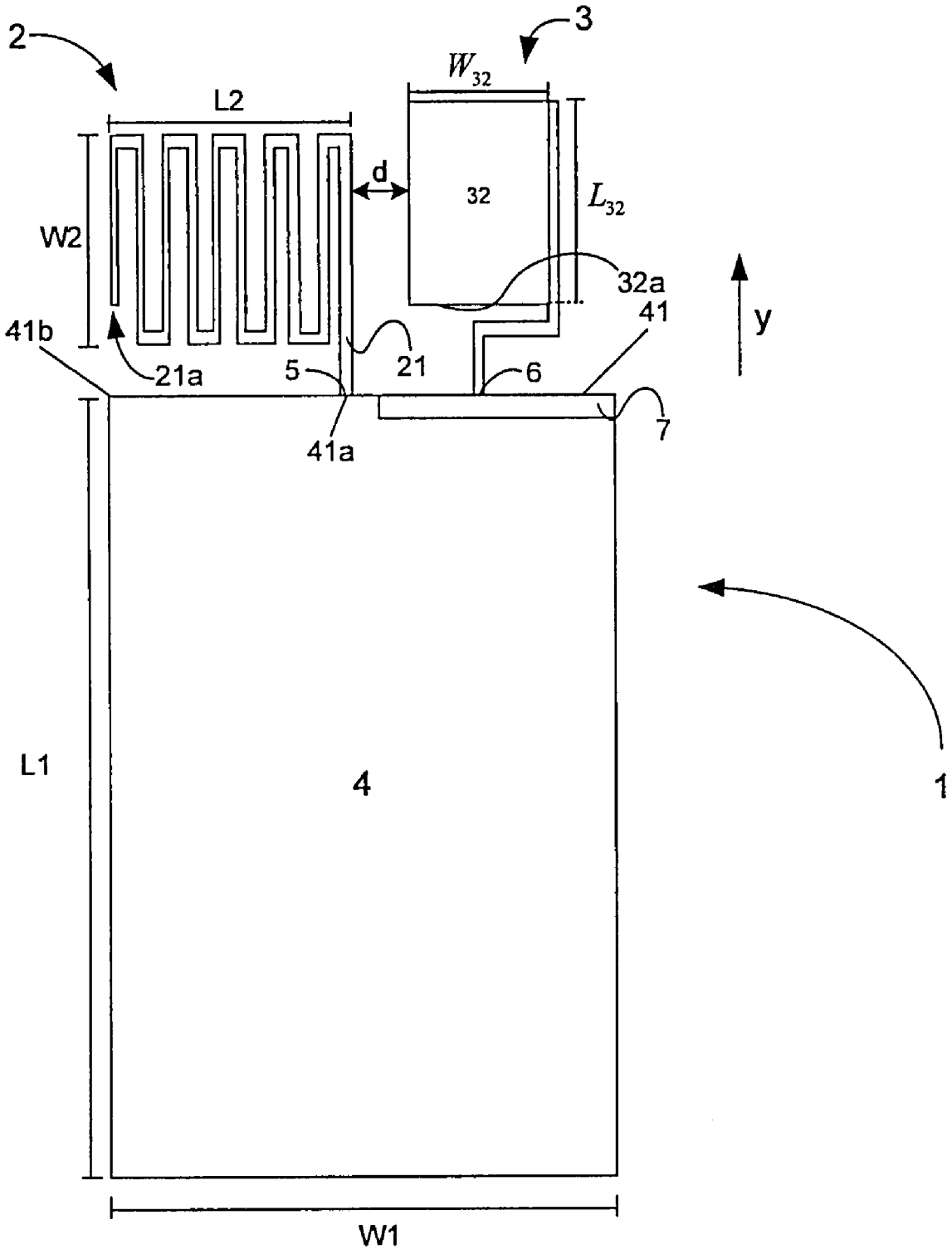
FIG. 1 is a front view of a multi-band radio antenna device according to an embodiment of the invention.

An embodiment of the present invention will be described more fully hereinafter with reference to the accompanying drawings. The embodiment of the invention is provided so that this disclosure will be thorough and complete, and will fully convey the scope of the invention to those skilled in the art. Like numbers refer to like elements throughout the drawings. The present description refers to radio terminals as devices in which to implement a radio antenna design according to embodiments of the present invention. The term radio terminal includes all mobile equipment devised for radio communication with a radio station, which radio station also may be mobile terminal or e.g. a stationary base station. Consequently, the term radio terminal includes mobile telephones, pagers, communicators, electronic organizers, smart phones, Personal Digital Assistants (PDA:s), vehicle-mounted radio communication devices, or the like, as well as portable laptop computers devised for wireless communication in e.g. a WLAN (Wireless Local Area Network). Furthermore, since the antenna device as such is suitable for but not restricted to mobile use, the term radio terminal should also be understood as to include any stationary device arranged for radio communication, such as e.g. desktop computers, printers, fax machines and so on, devised to operate with radio communication with each other or some other radio station. Hence, although the structure and characteristics of the antenna design according to embodiments of the invention is mainly described herein, by way of example, in the implementation in a mobile phone, this is not to be interpreted as excluding the implementation of the inventive antenna design in other types of radio terminals, for instance such as those listed above.

Some embodiments of the present invention provide an antenna design which is operable in UWB frequency bands, i.e. within the range from about 3.1 GHz up to and including 10.6 GHz. At the same time, the compact antenna design is such that it is suitable as a built-in antenna in a portable communication terminal, e.g. a mobile terminal. As used herein the term built-in antenna is used to mean that the antenna is placed inside, or adjacent to, the housing or chassis of the radio communication terminal. The compact size and the simultaneous capability of being operable at UWB frequencies makes this antenna design particularly suitable and attractive for implementation in future radio communication terminals, which are to be used in current and future mobile communication technologies such as GSM 800, GSM 850, GSM 900, GSM 1800, GSM 1900, 4 GSM, 9 UMTS, 2 WLAN, Bluetooth®g, etc. Computer simulations of the hereinbelow described antenna design have been performed using the simulation tool CST Microwave Studio® 2006B from COMPUTER SIMULATION TECHNOLOGY. These simulations show surprisingly good results, considering the relatively small dimensions of the antenna device of some embodiments of the invention.

An antenna concept or design will be described herein, comprising the antenna structure, its relation to ground, and its implementation in a radio terminal, with reference to the accompanying drawings. Some features of one embodiment of the antenna design are two antenna elements, wherein one of the antenna elements is operable in a lower frequency band region whereas the other of the antenna elements is operable in a higher frequency band region. In the preferred and disclosed embodiment, the first antenna element and the second antenna element are both monopole antenna elements. These two monopole antenna elements may have similar shapes. However, preferably the two monopole antenna elements have different shapes. For example, the first antenna element may be a meandered antenna element providing the antenna device, inter alia, with a compact size and the second antenna element may be a folded monopole antenna element for providing the antenna device with a capability to be operable at UWB frequency bands. The antenna design according to an embodiment of the invention will hereinafter be described in connection with FIGS. 1 through 3, wherein the antenna design is illustrated from different view angles.

Figure 2:
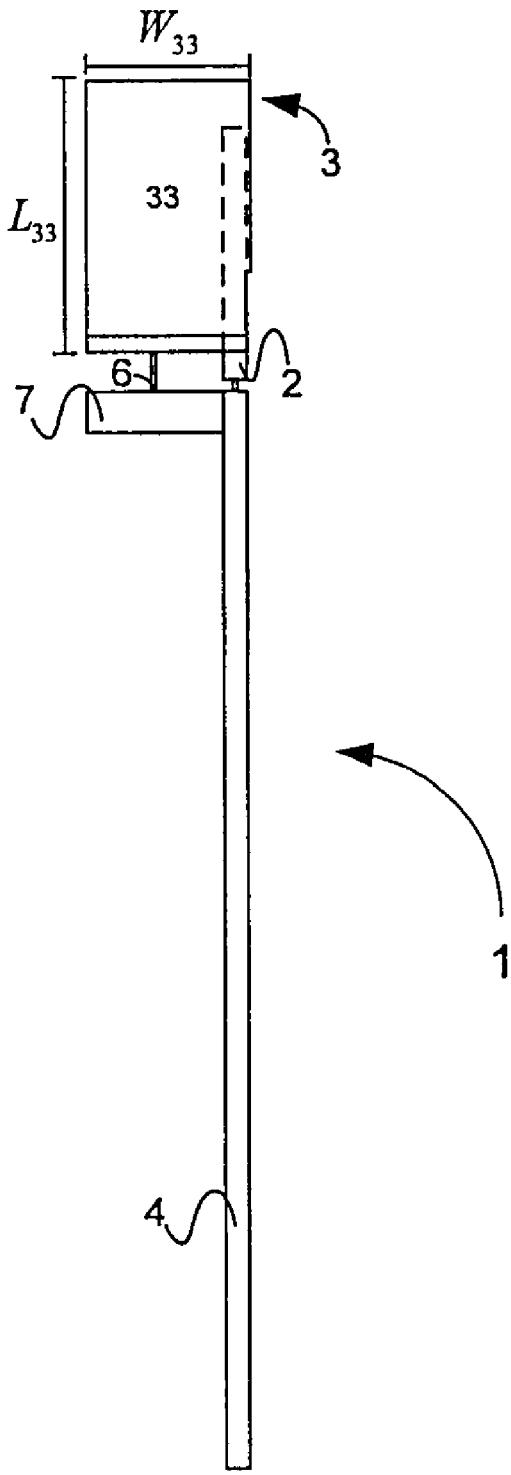
FIG. 2 is a side view of the antenna device of FIG. 1.
Figure 3:
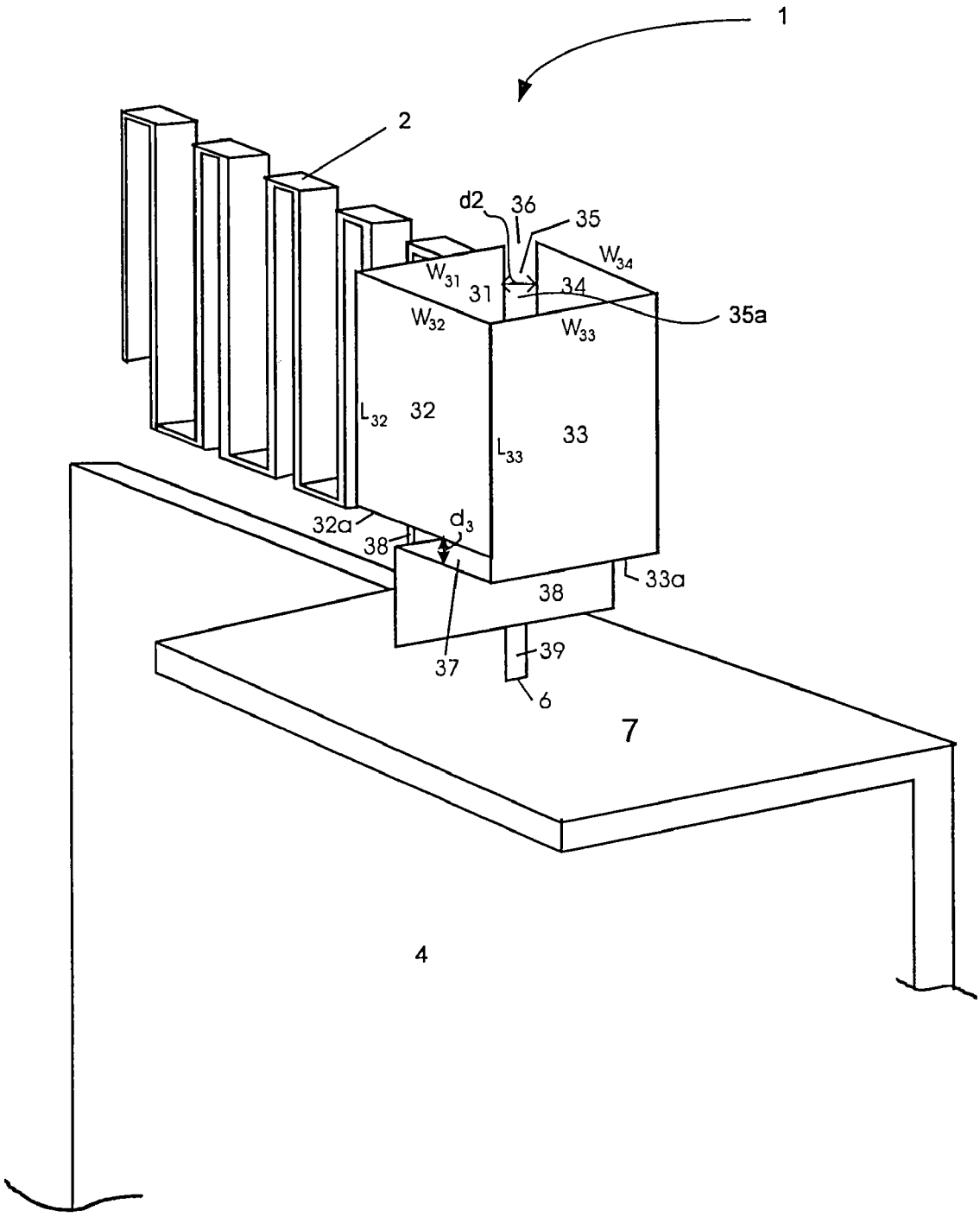
FIG. 3 is a three-dimensional view of an upper portion of the antenna device of FIGS. 1 and 2.

FIGS. 1-3 disclose an antenna device 1, comprising a first antenna element 2, a second antenna element 3 and a ground plane or substrate 4. In the preferred and disclosed embodiment, the length L1 of the ground plane 4, i.e. the height in FIG. 1, is approximately 100 mm. Furthermore, the width W1 in FIG. 1 is approximately 40 mm. However, it should be appreciated that the length L1 and the width W1 can be varied in dependence of the purpose of the antenna design and must hence be tested and evaluated in each specific case.

In the preferred and disclosed embodiment, the first antenna element 2 comprises an elongated meander member 21, which is fed at a feeding point 5. The feeding point may e.g. be a separate feeding point or a LC loading. The elongated meander member 21 provides for a flat antenna structure. Hence, it is possible to minimize the size of the antenna device 1. As can be seen in FIGS. 1-3, the flat first antenna element 2 is located in the same plane as the flat ground plane 4 in the direction y of extension of the ground plane 4. The elongated meander member 21 protrudes away from an upper side edge 41 of the ground plane 4. Furthermore, the elongated meander member 21 extends substantially in parallel with the upper side edge 41 of the ground plane 4 in a direction from a center portion 41*a* of the upper edge 41 towards an outer edge 41*b* of the upper edge 41. The length L2 of the elongated meander member 21 is about 19 mm and the width W2 of elongated meander member 21 is about 17 mm. Thus, the total length of the elongated meander member 21, from the feeding point edge 5 to the outer edge 21*a* is approximately 230 mm. It should nevertheless be appreciated that the length L2 and width W2 can be varied in dependence of the purpose of the antenna design and must hence be tested and evaluated in each specific case. Also, it should be appreciated that the number of meander turns could be varied in dependence of the purpose of the antenna design and must hence be tested and evaluated in each specific case.

In the preferred and disclosed embodiment, the second antenna element 3 comprises a folded monopole antenna element fed at a feeding point 6. As can be seen in FIGS. 1-3, one of the side surfaces (i.e. the side surface denoted 34) of the second antenna element 3 is located in the same plane as said ground plane 4 and in the same direction of extension as said first antenna element 2. Accordingly, in relation to the ground plane 4, the first antenna element 2 and the second antenna elements 3 are both located in the same direction of extension of the ground plane 2. The second antenna element 3 is located adjacent to, e.g. in proximity to, the first antenna element, such that the first and second antenna elements 2,3 are spaced apart from each other by a distance d. The distance d may e.g. be approximately 10 mm. Accordingly, the first antenna element 2 is separated from the second antenna element 3 by means of a gap with the distance d. It should be appreciated that the distance d can be varied in dependence of the purpose of the antenna design and must hence be tested and evaluated in each specific case. It should further be appreciated that the exact distance of d is not critical for the operation of some embodiments of the present invention. The main reason for this is that the first antenna element 2 and the second element 3 are configured to be operable at mutually different frequency band regions as will be further described hereinbelow. Additionally, the first antenna element 2 and the second element 3, respectively, are preferably fed by a respective feeding point 5, 6.

As can be seen in FIG. 2 and FIG. 3, the ground plane 4 may further comprise a protruding support member 7. The support member 7 may be a rectangular support member. The support member 7 may be attached to the upper side edge 41 of the ground plane 4. Furthermore, the support member 7 may protrude substantially perpendicularly out from the ground plane 2. In the preferred and disclosed embodiment of the antenna device 1, the second radio signal feeding point is disposed at a center portion of the support member 7 as shown in FIGS. 2 and 3.

In the preferred and disclosed embodiment of the antenna device 1, the second antenna element 3 has a three-dimensional box-like shape. It has turned out that this three-dimensional box-like shape yields a large effective antenna volume which contributes to surprisingly good VSWR characteristics in UWB frequency band regions, as will be further described with respect to FIG. 6. At the same time, as is evidenced by the following description taken in conjunction with the drawings, the dimensions of this three-dimensional box-like antenna element is such that it is attractive for incorporation in small-sized devices, e.g. portable communication terminals.

The second antenna element 3 comprises a first side surface 31, a second side surface 32, a third side surface 33 and a fourth side surface 34, which are folded in relation to each other such that these side surfaces 31, 32, 33, and 34 together form the three-dimensional box-like shape. In the preferred and disclosed embodiment, the first side surface 31 abuts perpendicularly against the second side surface 32. Likewise, the second side surface 32 abuts perpendicularly against the third side surface 33. In the same way, the third side surface 33 abuts perpendicularly against the fourth side surface 34. It has turned out that it may be advantageous that the above-mentioned surfaces abut perpendicularly against each other, i.e. with an angle of about 90° between each other, as is illustrated in the accompanying drawings. However, it should of course be appreciated that it is not necessary that the above-mentioned surfaces abut exactly perpendicularly against each other. Other angles may be equally possible, e.g. angles of about 60-90°. As can be seen in FIG. 3, the three-dimensional box-like shaped antenna element 3 also comprises a hollow interior 35 with two opposite open ends, i.e. an upper open end 35*a* and a lower open end 35*b*. The lower open end 35*b* is located opposite said upper open end 35*a*. Moreover, as is clearly illustrated in FIG. 3, there is a relatively narrow opening or gap 36 between the first side surface 31 and the fourth side surface 34. Consequently, a non-closed box-like shape is formed by the four side surfaces 31, 32, 33, 34, the hollow interior 35, the upper and lower open ends 35*a*, 35*b*, and the gap 36. The distance d2 of the gap 36 may e.g. be 2 mm. However, the exact distance d2 is not critical for the function of the second antenna element 3. It should be appreciated that the distance d2 can be varied in dependence of the purpose of the antenna design and must hence be tested and evaluated in each specific case.

In the disclosed embodiment, the first side surface 31 has a width $W_{31}$ of approximately 8 mm and a length $L_{31}$ of approximately 17 mm. Furthermore, the second side surface 32 has a width $W_{32}$ of approximately 10 mm and a length $L_{32}$ of approximately 17 mm. Also, the fourth side surface 34 has a width $W_{34}$ of approximately 10 mm and a length $L_{34}$ of approximately 17 mm. The third side 33 has a width $W_{33}$ of approximately 10 mm. Furthermore, the third side surface 33 has a length $L_{33}$ which is longer than the lengths $L_{31}$, $L_{32}$ and $L_{34}$, respectively. For example, the length $L_{33}$ may be about 19 mm. The above-mentioned dimensions are illustrative examples of suitable dimensions. However, it should be appreciated that the exact dimensions could be varied in dependence of the purpose of the antenna design. In fact, the dimensions may indeed be up to the artistic freedom of the person skilled in the art and should therefore be tested and evaluated in each specific case.

A lower portion 33*a* of the third side 33 abuts perpendicularly against a fifth surface 37, which is located at a distance d3 away from lower portions 32*a* and 34*a* of the second and fourth side surfaces 32, 34, respectively. Thus, there is formed a relatively narrow opening or gap 38 between the fifth surface 37 and the lower portions 32*a* and 34*a*. It should be noted that the exact distance d3 is not critical for the function of the second antenna element 3. Therefore, it should be appreciated that the distance d3 can be varied in dependence of the purpose of the antenna design and must hence be tested and evaluated in each specific case. In the disclosed and preferred embodiment, the fifth surface 37 further abuts perpendicularly to a sixth surface 38, which in turn is attached to a feeding portion 39. The feeding portion 39 is connected to the second radio signal feeding point 6 disposed at the support member 7 of the ground plane 4.

According to the preferred and disclosed embodiment of the antenna device 1, the antenna device 1 is configured to be tuned for a lower and a higher frequency band, respectively. The antenna device 1 comprising both the first and the second antenna elements 2, 3, respectively, therefore provides for a radio antenna device which is operable at mutually different frequency bands. Thus, the antenna device 1 provides for a combination of the first and second antenna elements 2, 3, respectively. The first antenna element 2 is configured to be operable in the lower frequency band, e.g. a frequency band located in the 800 MHz, 900 MHz or 1500 MHz region. Thus, the first antenna element may, for example, be configured for GSM 800 and GSM 900. Furthermore, the second antenna element 3 is configured to be operable in the higher frequency band, e.g. a frequency band region located in the 1800 MHz, 1900 MHz, 2.0 GHz, 2.45 GHz, 3.1 GHz, 5.0 GHz, 5.8 GHz or 10.6 GHZ region. A switch (not shown) may be provided in the antenna device 1, such that it is possible to switch between low frequency bands utilizing the first antenna element 2 and higher frequency bands utilizing the second antenna element 3. In one embodiment, when implemented in a communication terminal, e.g. mobile phone 40 (see FIG. 4), the second antenna element 3 may be configured to function together with the chassis of the communication terminal to match the antenna element 3 from e.g. 1.7 GHz up to and including 10.6 GHz frequency band regions. Consequently, the second antenna element 3 may e.g. be configured for GSM 1800, GSM 1900, or above. Accordingly, the first and second antenna elements 2, 3 are configured to operate at mutually different frequency band regions. Computer simulations have shown good results for both the first and the second antenna elements 2, 3, separately. Thus, each of the antenna elements 2, 3 individually shows good performance. Furthermore, as is evidenced by the dimensions of the disclosed embodiment, the inventive antenna design is suitable for antennas to be internally built into communication terminals with compact size.

Figure 4:
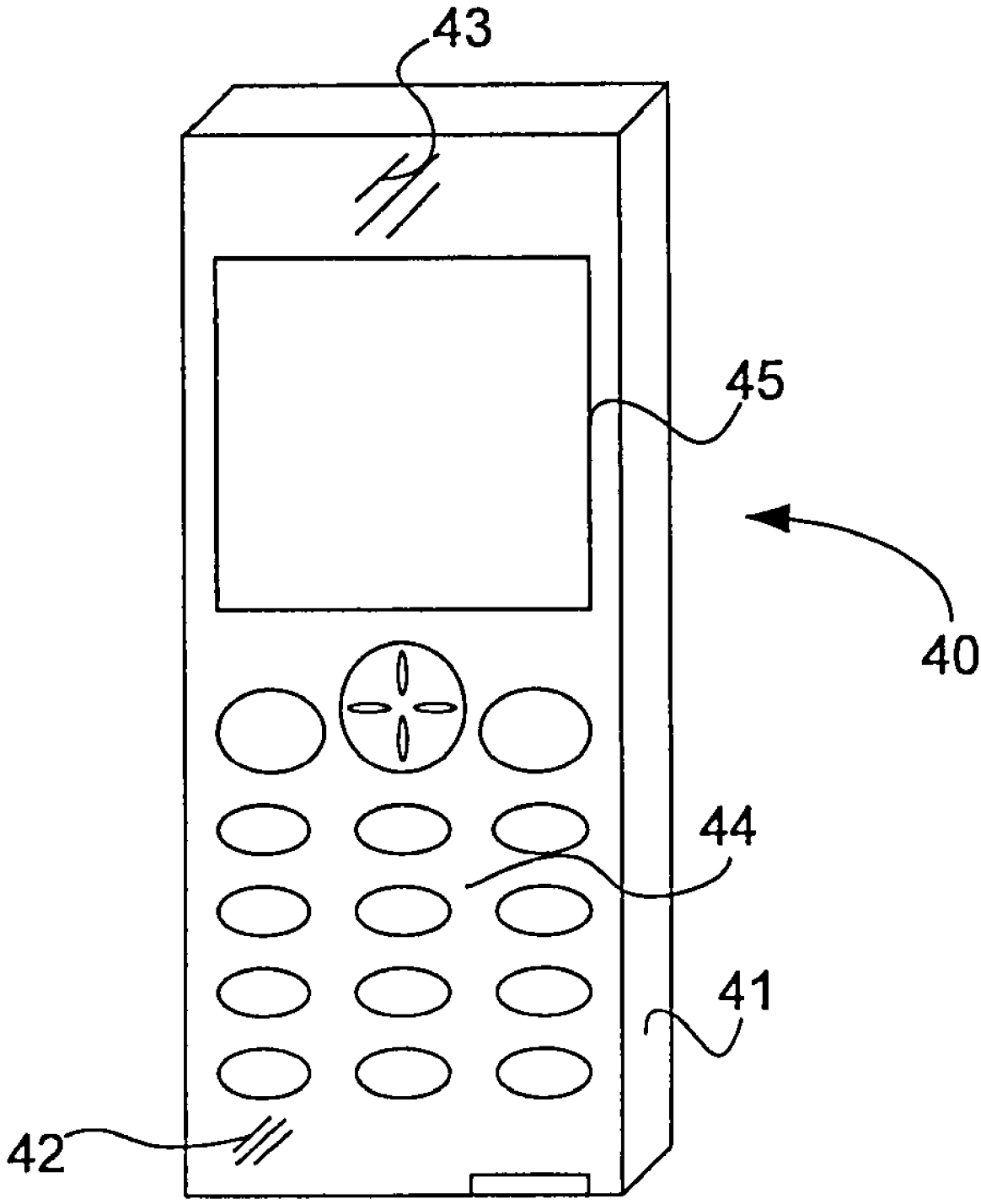
FIG. 4 is an exemplary communication terminal incorporating the antenna device illustrated in FIGS. 1-3.

FIG. 4 illustrates a communication radio terminal in the embodiment of a cellular mobile phone 40 devised for multi-band radio communication. It should be understood that the outer appearance of the mobile phone 40 need not take the indicated shape of FIG. 4. Instead the mobile phone 40 may e.g. be of a clamshell type, a jack knife type, or the like. The terminal 40 comprises a chassis or housing 41, carrying a user audio input in the form of a microphone 42 and a user audio output in the form of a loudspeaker 43 or a connector to an ear piece (not shown). A set of keys, buttons or the like constitutes a data input interface 44 usable e.g. for dialing, according to the established art. A data output interface comprising a display 45 is further included, devised to display communication information, address list etc in a manner well known to the skilled person. The radio communication terminal 40 also includes radio transmission and reception electronics (not shown), and is further devised with a built-in antenna device 1 inside the housing 41. According to an embodiment of the present invention, this antenna device 1, corresponding to FIGS. 1-3, includes a first flat monopole antenna element 2, a second monopole antenna element 3 and a flat ground plane or substrate 4. The antenna device is operable in a first and a second frequency band region, respectively. The first frequency band region is a lower frequency band region than the second frequency band region. The first monopole antenna element 2 has a first radio signal feeding point 5 disposed at the ground plane 4, wherein the first monopole antenna element 2 is configured to be operable in the first frequency band region and is further located in the same plane as said ground plane 4 in the direction of extension of said ground plane 4. The second monopole antenna element 3 has a second radio signal feeding point 6 disposed at the ground plane 4, wherein the second monopole antenna element 3 is configured to be operable in the second frequency band region and is further a folded monopole antenna element located adjacent to said first antenna element 2. The monopole antenna elements 2, 3 may have different shapes, e.g. the second antenna element 3 is a folded monopole antenna element whereas the first antenna element comprises an elongated meander portion. The other features of the antenna design according to the present invention described hereinabove with reference to FIGS. 1-3 are naturally equally valid for the radio terminal implemented embodiment of FIG. 4.

Figure 5:
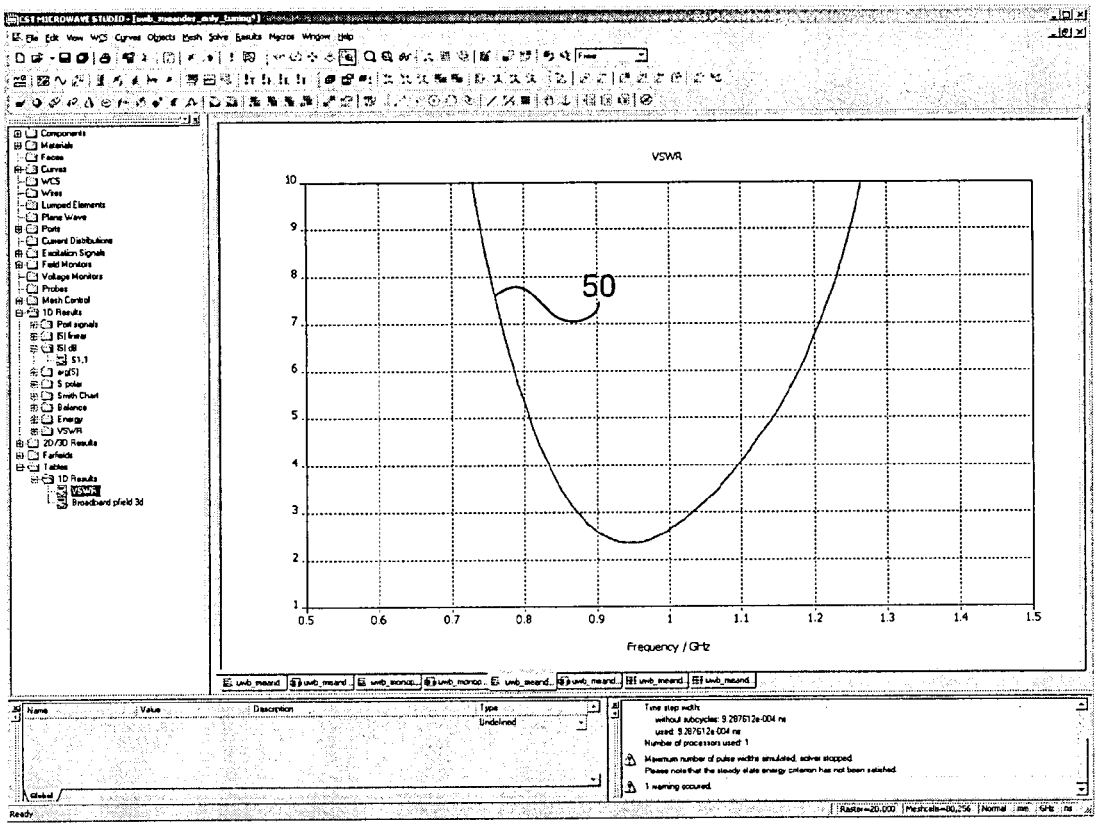
FIG. 5 illustrates the Voltage Standing Wave Ratio (VSWR) characteristics for a first antenna element of the antenna device of FIGS. 1-3.
Figure 6:
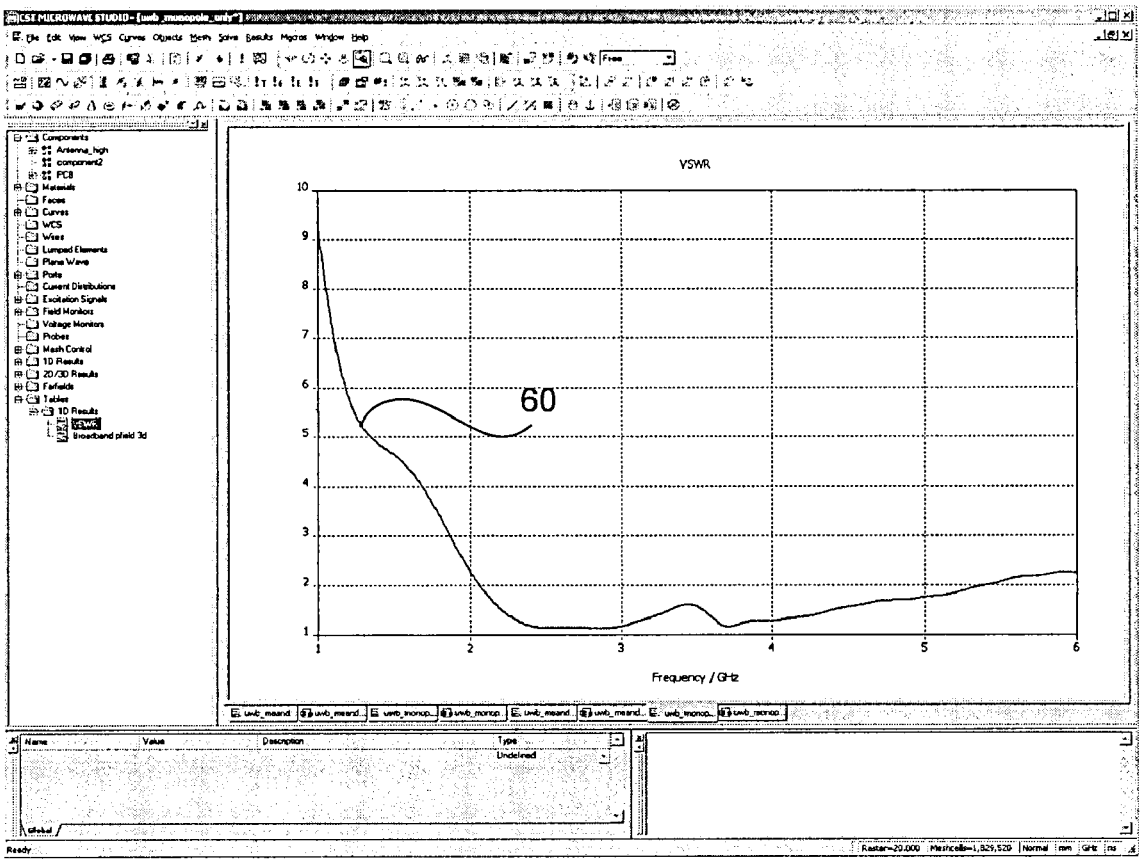
FIG. 6 illustrates the Voltage Standing Wave Ratio (VSWR) characteristics for a second antenna element of the antenna device of FIGS. 1-3.

FIG. 5 illustrates the VSWR performance of the first antenna element 2 of the presented antenna design, in an embodiment as described in conjunction with FIGS. 1-3, i.e. with the dimensions in the preferred and disclosed embodiment. As can be seen from FIG. 5, the VSWR 50 is below 5.0 for frequencies from approximately 0.8-1.15 GHz. Consequently, the performance of the antenna device is considered to have a sufficiently good performance in this frequency band region. FIG. 6, on the other hand, illustrates the VSWR performance of the second antenna element 3 of the presented antenna design, in an embodiment as described in conjunction with FIGS. 1-3, i.e. with the dimensions in the preferred and disclosed embodiment. As can be seen from FIG. 6, the VSWR 60 is below 5.0 for frequencies from approximately 1.6 GHz and above. Consequently, the performance of the antenna device is considered to have a sufficiently good performance in UWB frequency band regions.

Figure 7:
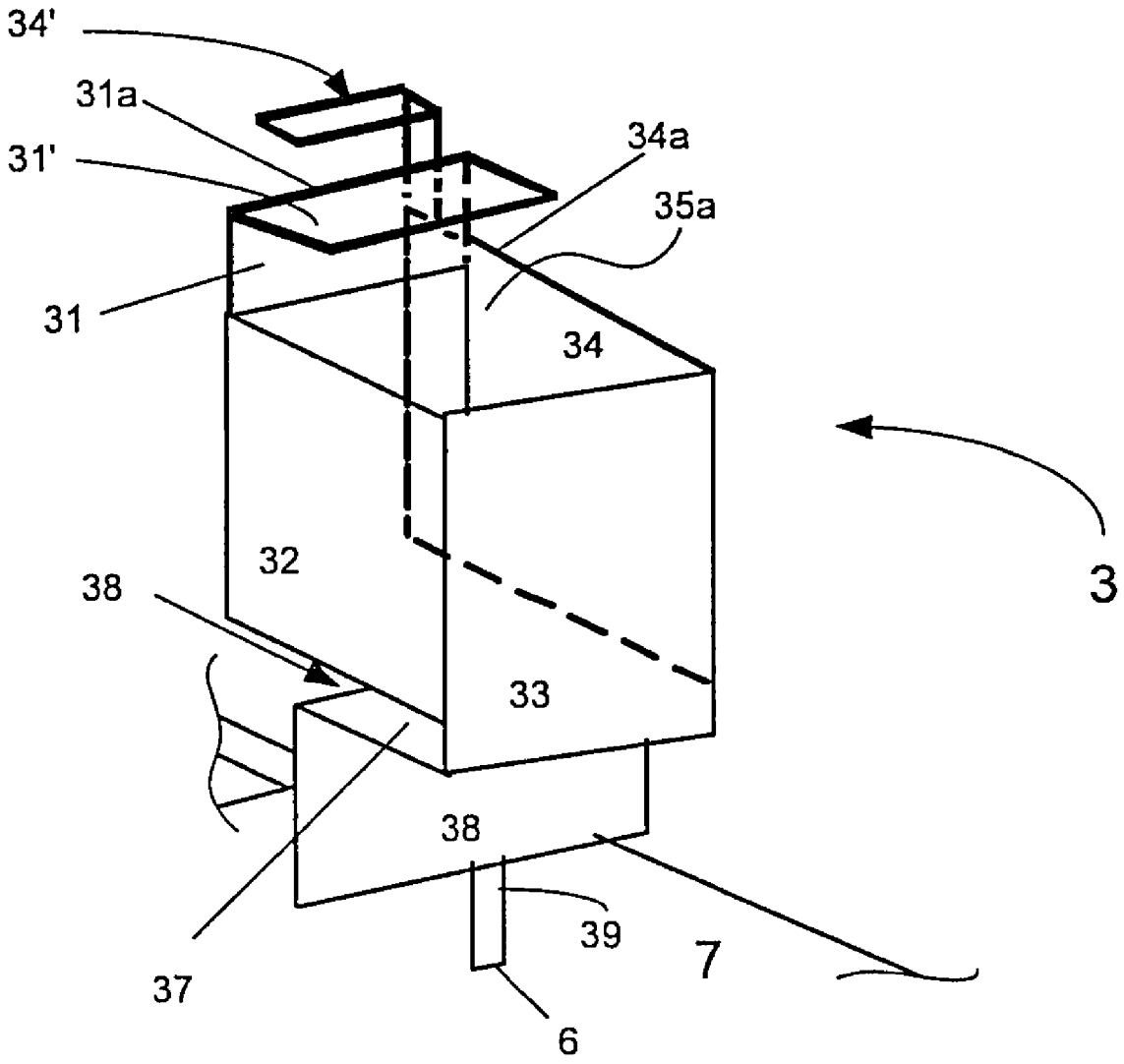
FIG. 7 illustrates an alternative shape of the second antenna element of the antenna device of FIGS. 1-3.

Embodiments of the present invention has been described above with reference to an antenna device 1 comprising a first antenna element 2 and a second antenna element 3, wherein the second antenna element antenna has a folded three dimensional box-like shape. However, other shapes of the second antenna element 3 than those described are also possible within the scope of the invention. As a mere example, the second element 3 may have a shape as illustrated in FIG. 7. Accordingly, the first side surface 31 may further comprise a protruding member 31' at an upper edge 31*a* of the first side surface 31. The protruding member 31' may protrude substantially perpendicularly out from said first side surface in a direction such that the protruding member 31' covers at least a portion of the upper open end 35*a*. Moreover, the fourth side surface 34 may further comprise a protruding member 34' at an outermost side edge of the fourth side surface (as is disclosed in FIG. 7), wherein said outermost side edge 34*a* does not abut against any other side surface, and wherein the protruding member 34' protrudes substantially perpendicularly out from an upper edge 34*a* of said fourth side surface 34.

The terminology used in this specification is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

The foregoing has described the principles, preferred embodiments and modes of operation of the present invention. However, the invention should not be construed as being limited to the particular embodiments discussed above. For example, while the antenna of the present invention has been discussed primarily as being suitable for antennas to be incorporated into small-sized devices, e.g. portable communication terminals, the antenna design could equally possible be implemented as an external antenna device or the like e.g. mounted onto the chassis of a portable communication terminal. Furthermore, while the antenna of the present invention has been discussed primarily as being a radiator, one skilled in the art will appreciate that the antenna of the present invention would also be used as a sensor for receiving information at specific frequencies. Similarly, the dimensions of the various elements may vary based on the specific application. Thus, the above-described embodiments should be regarded as illustrative rather than restrictive, and it should be appreciated that variations may be made in those embodiments by persons skilled in the art without departing from the scope of the present invention as defined by the appended claims.

We claim:

1. A radio antenna device for a radio communication terminal, wherein the antenna device is operable in a first and a second frequency band region, respectively, the first frequency band region being a lower frequency band region than the second frequency band region, the antenna device comprising:

a flat ground plane;

a flat first monopole antenna element having a first radio signal feeding point disposed at the ground plane, wherein the flat first monopole antenna element is located in the same plane as said ground plane in a direction of extension of said ground plane; and a folded second monopole antenna element having a second radio signal feeding point disposed at the ground plane, wherein the folded second monopole antenna element comprises a three-dimensional box-like shape and is located adjacent to said flat first antenna element; and wherein the flat first monopole antenna element is operable in the first frequency band region and the second monopole antenna element is operable in the second frequency band region.

2. The antenna device according to claim 1, wherein the folded second monopole antenna element comprises a plurality of side surfaces and at least one of said side surfaces is located in the same plane as said ground plane in the same direction of extension as said flat first antenna element.

3. The antenna device according to claim 2, wherein the folded monopole antenna element comprises:

first, second, third, and fourth side surfaces, respectively, wherein the first side surface abuts perpendicularly against the second side surface, the second side surface abuts perpendicularly against the third side surface, the third side surface abuts perpendicularly against the fourth side surface, and there is a gap between the first and fourth side, wherein the first, second, third and fourth side surfaces together enclose a hollow interior, the hollow interior having two open ends which are located opposite to each other, and wherein the first, second, third, and fourth side surfaces, the hollow interior, and the two open ends of the hollow interior are arranged in relation to each other such that a non-closed box-like shape is formed by the first, second, third, and fourth side surfaces, the hollow interior, and the two open ends of the hollow interior.

4. The antenna device according to claim 3, further comprising:

fifth and sixth surfaces, wherein a lower portion of the third side surface abuts perpendicularly against the fifth surface, and the fifth surface abuts perpendicularly against the sixth surface, the sixth surface further being attached to a feeding portion connected to the second radio signal feeding point.

5. An antenna device according to claim 4, the ground plane further comprising a support member attached to said ground plane at a side edge of said ground plane and further protruding substantially perpendicularly out from said ground plane, wherein the second radio signal feeding point is disposed at a center portion of said support member.

6. The antenna device according to claim 1, wherein the first radio signal feeding point and the second radio signal feeding point are separate feeding points.

7. The antenna device according to claim 1, wherein the flat first antenna element comprises an elongated meander portion.

8. The antenna device according to claim 7, wherein the elongated meander portion protrudes away from the side edge of the ground plane and extends substantially parallel to said side edge in a direction from a center portion of said side edge towards an outer edge of said side edge.

9. The antenna device according to claim 1, wherein the first antenna element is configured to be operable in the first frequency band, the first frequency band being a frequency band located in the 800 MHz, 900 MHz or 1500 MHz region.

10. The antenna device according to claim 1, wherein the second antenna element is configured to be operable in the second frequency band, the second frequency band being a frequency band located in the 1800 MHz, 1900 MHz, 2.0 GHz, 2.45 GHz, 3.1 GHz, 5.0 GHz, 5.8 GHz or 10.6 GHZ region.

11. The antenna device according to claim 1, wherein the second antenna element is operable in a frequency band being a frequency band located within the range of 3.1-10.6 GHz.

12. A communication terminal comprising an antenna device according to claim 1.

13. The communication terminal according to claim 12, wherein the communication terminal is a device from the group comprising: a portable radio communication equipment, a mobile radio terminal, a mobile telephone, a cellular telephone, a pager, a communicator, an electronic organizer, a smart phone and a computer.

* * * * *